United States Patent [19]

Wiggins et al.

[11] Patent Number: 4,993,384

[45] Date of Patent: Feb. 19, 1991

[54] ELECTRIC MOTOR OPERATED THROTTLE FOR I.C. ENGINE POWERED AUTOMOTIVE VEHICLE

[75] Inventors: Kregg S. Wiggins, Clarkston, Mich.; Danny O. Wright, Newport News, Va.

[73] Assignee: Siemens Automotive L.P., Troy, Mich.

[21] Appl. No.: 505,083

[22] Filed: Apr. 4, 1990

[51] Int. Cl.[5] ..... F02D 7/00

[52] U.S. Cl. ..... 123/399; 123/489; 123/DIG. 11

[58] Field of Search ..... 123/399, 630, 429, 198 D, 123/198 DB, DIG. 11, 489; 74/866

[56] References Cited

U.S. PATENT DOCUMENTS

| | | | |
|---|---|---|---|
| 4,059,088 | 11/1977 | Tateno et al. | 123/DIG. 11 |
| 4,083,267 | 4/1978 | Raaz | 123/DIG. 11 |
| 4,106,469 | 8/1978 | Day | 123/DIG. 11 |
| 4,244,334 | 1/1981 | Maisch | 123/DIG. 11 |
| 4,462,355 | 7/1984 | Ozaki et al. | 123/DIG. 11 |
| 4,513,706 | 4/1985 | Atect | 123/DIG. 11 |
| 4,895,123 | 1/1990 | Uchinami et al. | 123/489 |
| 4,909,213 | 3/1990 | Mazger et al. | 123/399 |
| 4,938,196 | 7/1990 | Hoshi | 123/489 |
| 4,947,819 | 8/1990 | Takahashi et al. | 123/489 |

*Primary Examiner*—Raymond A. Neill

*Attorney, Agent, or Firm*—George L. Boller; Russel C. Wells

[57] ABSTRACT

An accelerator pedal position signal is transmitted by wire to the electronic control unit which operates a unipolar stepper motor to position the throttle in correspondence with the position of the accelerator pedal. A circuit of the electronic control unit monitors the response of the throttle to the release of the accelerator pedal and to the operation of the brake pedal in such a manner that unless the throttle is at, or at least within a predetermining distance of, its idle position within a certain limited time after the commencement of concurrence of accelerator pedal release and brake pedal application, the engine is shut down.

9 Claims, 1 Drawing Sheet

ELECTRIC MOTOR OPERATED THROTTLE FOR I.C. ENGINE POWERED AUTOMOTIVE VEHICLE

FIELD OF THE INVENTION

This invention relates to an automotive vehicle that is powered by an internal combustion engine whose throttle is operated over a range extending from idle to full open by an electric motor under the command of an electrical control circuit that receives input from the vehicle operator.

BACKGROUND AND SUMMARY OF THE INVENTION

Commonly owned U.S. Pat. Nos. 4,850,319, 4,855,660, and 4,869,220 are applicable to an electronic throttle control for an I.C. engine powered automotive vehicle. Basically, an electronic throttle control comprises an electromechanical system replacing the heretofore strictly mechanical operative coupling via which the vehicle driver operates the engine throttle. A sensor associated with the vehicle's accelerator pedal provides an electric signal input to an electronic control unit which operates an electric motor to position the throttle in accordance with the driver's command.

While significant advantages can be derived from the incorporation of an electronic throttle control into an I.C. engine powered automotive vehicle, as seen in the referenced commonly owned patents, the well-known conservative philosophies of automobile manufacturing companies are barriers to the adoption of other than cosmetic changes to their products. Since domestic manufacturers are viewed in some quarters as pleasantly enjoying a shared monopoly, the sole incentives for substantive improvements in their products are seen by some to consist only of those which are either coerced by government fiat or else calculated by the manufacturers to handsomely increase their profits. Since the manufacture of automotive vehicles has historically developed as a smokestack industry, it is not an unduly unfair observation to say that the industry harbors an innate resistance to, perhaps approaching the point of fear of, the introduction of modern electronic technology into its products. Accordingly, an independent electronics company that pioneers the development of new electronic technology for automotive vehicle applications must be highly innovative and creative in order for that technology to have any chance for acceptance by automotive manufacturers where either essential compliance with government regulations or immediate profit returns otherwise hold sway.

The present invention relates to an improvement for furthering acceptance of an electronic throttle control by an automotive manufacturer. More specifically the invention relates to a novel means for assuring correspondence of motorized throttle operation to that which is intended by the actions of the vehicle operator and for rendering suitable contingency action in the unlikely event that correspondence becomes unacceptably disparate. One of the especially unique aspects of the invention resides in its relative simplicity, for its principles can be embodied in a what is essentially a single electrical circuit portion of an electronic throttle control system.

Described in one manner, the invention comprises a means for selectively allowing or disallowing continuance of engine operation depending upon the driver's use of the accelerator and the brakes, and the throttle position that results from the actions of the driver. Engine operation is allowed to continue as long as the throttle attains at least a certain degree of engine throttling within a certain time limit after the concurrence of signals indicating that the accelerator has been released and that the brakes have been applied. Non-attainment of such a condition disallows continuance of engine operation.

Principles of the invention will be disclosed in the ensuing detailed description of a presently preferred embodiment and in the accompanying claims. Drawings also accompany the disclosure and illustrate the presently preferred embodiment in the best mode contemplated by the inventors for putting the invention into practice.

DESCRIPTION OF THE PREFERRED EMBODIMENT

Figure 1:
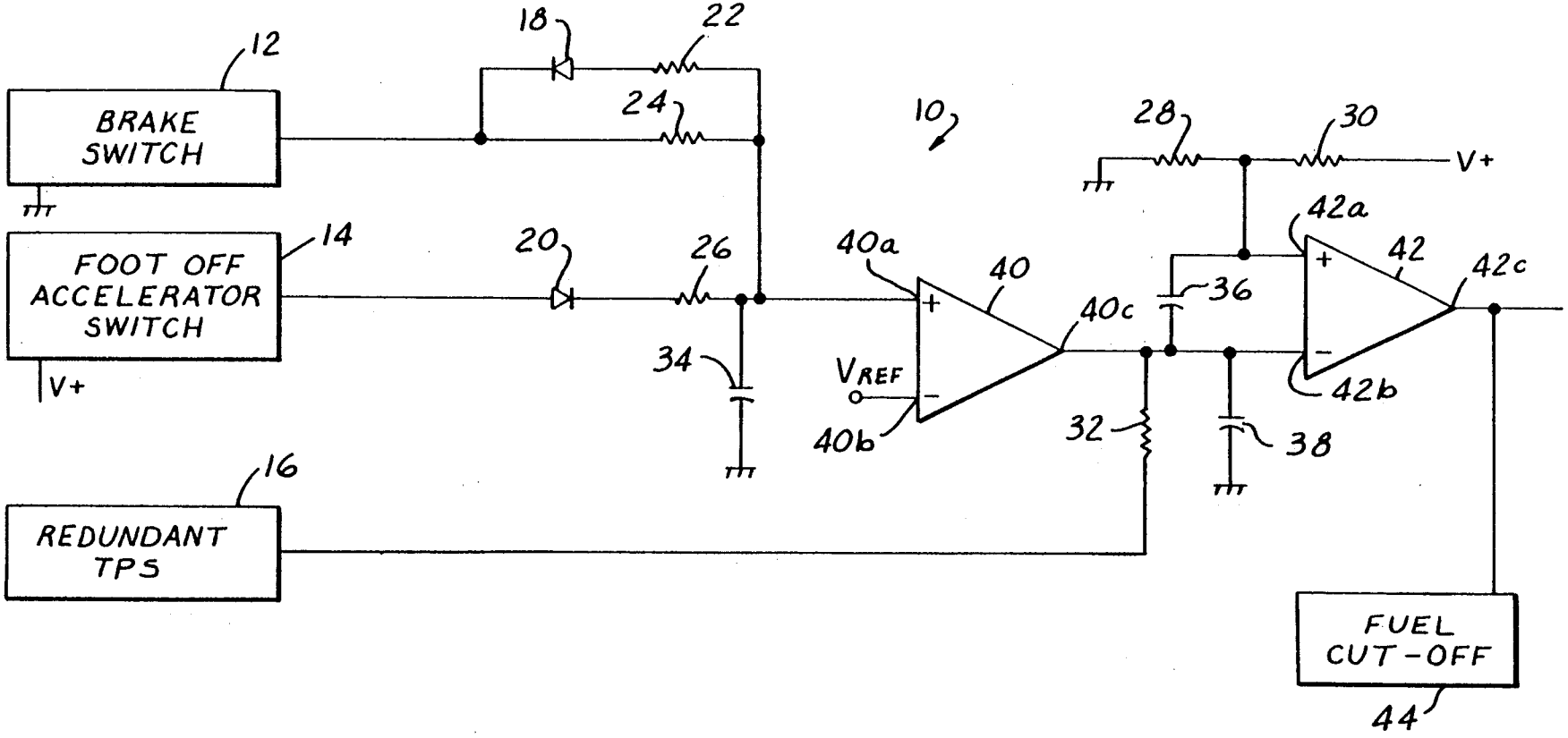
FIG. 1 is a schematic diagram of a circuit constructed in accordance with the inventive principles.

A circuit 10 presented in FIG. 1 is used in one portion of the electronic control unit of an electronic throttle control system described in U.S. Pat. No. 4,869,220. The electronic throttle control system also includes an electromechanical throttle actuator of the type described in U.S. Pat. No. 4,850,319 and comprising a stepper motor as the prime mover for positioning the throttle. U.S. Pat. No. 4,855,660 describes a circuit which is especially well-suited for operating a stepper motor to selectively position the throttle.

Circuit 10 comprises the following components: a brake switch 12; a foot off accelerator switch 14; a redundant throttle position sensor (redundant TPS) 16; diodes 18 and 20; resistors 22, 24, 26, 28, 30, and 32; capacitors 34, 36, and 38; comparators 40 and 42; and a fuel-cut off 44, connected as illustrated.

Switch 14 serves to distinguish between depressed (non-idle) and non-depressed (idle) positions of the vehicle's accelerator pedal; switch 12 to distinguish between depressed (braking) and non-depressed (non-braking) positions of the vehicle's brake pedal which operates the vehicle's brakes; and redundant TPS 16 to signal the position of the engine throttle (degree of throttling). Redundant TPS 16 is referred to as "redundant" because the preferred system incorporates two throttle position sensors, the second being for redundancy in case of failure of the first, and it is to be understood that a throttle position signal does not have to be obtained exclusively from the redundant TPS.

One input **40*b* of comparator 40 is referenced to Vref. Switches 12 and 14 are connected in an input circuit to the other input 40*a* of comparator 40. This input circuit comprises capacitor 34 being shared with the two switches 12 and 14 respectively, namely by the series-connected diode 20 and resistor 26 in the case of switch 14, and by the series-connected diode 18 and resistor 22 in the case of switch 12**.

Comparator 40 functions in a conventional manner such that when the signal at input **40*a* is high relative to Vref, the comparator output 40*c* is pulled down to ground, and when the signal at input 40*a* is low relative to Vref, the comparator output 40*c* is allowed to float. Switches 12 and 14 are arranged and constructed in the circuit to input 40*a* such that the signal at input 40*a* can be made low relative to Vref only upon the concurrence of the accelerator pedal being fully released by the vehicle operator (i.e., the accelerator pedal being in idle) and of the brakes being other than fully released by the operator (i.e., brakes being applied). For all other combinations of conditions of the two switches, the signal at input 40***a* is high relative to Vref.

With such organization and arrangement of its input circuit, comparator 40 forces the input 42*b* of comparator 42 low relative to the effective fraction of V+ volts that is delivered to its input 42*a* by the voltage dividing effect of resistors 28 and 30, unless the brakes are in actuated condition concurrently with the accelerator being in fully released condition.

Comparator 42 functions in conventional fashion so that only if the brakes are being applied concurrently with the accelerator being released, does it become possible for the output 42*c* of comparator 42 to float. In other words, the output of comparator 42 is pulled down to ground for all other combinations of conditions of the two switches irrespective of the particular signal delivered from redundant TPS 16.

Accordingly, it is possible to the signal from redundant TPS 16 to exercise influence over comparator 42 only upon concurrence of the accelerator commanding the engine to idle and of the brake forcing some degree of deceleration. But this possibility does not necessarily mean that the redundant TPS signal will in fact exercise influence over comparator 42. It is only when the redundant TPS signal has a sufficiently large magnitude for a sufficiently long time that the output of comparator 42 will actually float. The particular characteristics of the redundant TPS signal that will switch comparator 42 from one state to the other are determined by the value of a time constant associated with the input circuit to comparator 42, namely that defined by resistor 32 and capacitor 38. Capacitor 36 is for noise immunity purposes. The preferred design selection is such that if the redundant TPS does not indicate that the throttle position is within a predetermined amount of its idle position within a certain limited time after the concurrence of brake pedal actuation and accelerator pedal is indicated by the change of state of comparator 40, then output 42*c* of comparator 42 is allowed to float. This limited time period is rather short, for example 200 msecs., may be quite appropriate in many designs.

The allowance of output 42*c* of comparator 42 to float causes fuel cut-off 44 to arrest the flow of fuel to the engine and shut down the engine. The purpose in causing such a shut-down is to terminate engine operation under a condition that is indicative of loss of correspondence between the actual position of the engine throttle and the throttle position intended by the actions of the vehicle operator. In other words, the action of the driver in releasing the accelerator pedal and applying the brake is indicative of the desirability for the throttle to assume a minimum opening, i.e. idle, condition. If the throttle position signal from redundant TPS 16 does not indicate a position at, or at least very close to, idle within a certain limited time after such action by the operator, an undesired discrepancy between actual and desired throttle operation is deemed to have occurred and an appropriate response to this discrepancy is to shut the engine down, such as by terminating the fuel flow to the engine. Engine shut-down is an appropriate response under such a circumstance because it is obviously the operator's intention to decelerate the vehicle, and there is no point in applying the brakes against a engine that is apparently attempting to override them.

Hence, the circuit may also be considered to perform a logic function to allow continuance of engine operation unless the accelerator sensor (i.e., switch 14), the brake sensor (i.e., switch 12), and the throttle position sensor 16 concurrently respectively sense that the accelerator is commanding less than a certain speed for the vehicle, that the brake is in other than a fully released condition, and the throttle mechanism is not causing at least a selected degree of throttling, in which case continuance of engine operation is disallowed.

In the illustrated circuit, the reader can see that the time constant associated with the redundant TPS signal is not the sole time constant which is present. There is also one associated with the input circuit to comparator 40*a*. While this time constant is calibratable for any particular automotive vehicle by appropriate selection of circuit components, its purpose is to insure that a predetermined minimum time is imposed on the concurrency of accelerator pedal release and brake application before the circuit ever "looks at" the redundant TPS signal. This feature is desirable to avoid the occurrence of spurious engine shut-downs that might occur if no, or only negligible, timing requirements were to be imposed on such concurrency. An example of such a minimum timing requirement could be one-half second in the case of an automatic transmission vehicle and two seconds in the case of a manual transmission vehicle.

Moreover, the arrangement of diode 18 and resistors 22 and 24 in circuit creates an asymmetry in the charging and discharging of capacitor through brake switch 12. If the brake pedal is released before the expiration of the minimum timing interval required to switch the state of comparator 40, and then re-applied, the minimum timing interval is re-started.

A final point to be observed is that the two switches 12 and 14 are arranged such that if there is a broken wire or connection from either, that switch is asserted. In this way, the non-functionality of either switch due to a broken wire or connection is apt to be promptly detected.

With the invention, an electronic throttle control cannot be legitimately criticized for failing to address a possible loss of desired correspondence between actual and intended throttle position. This should enhance the potential for the acceptance and adoption of electronic throttle control by automobile manufacturers.

While a presently preferred embodiment of the invention has been disclosed, it is to be understood that principles of the invention may by embodied in other equivalent constructions. For example the functions performed by the illustrated circuit could be embodied in suitable software in a microprocessor.

What is claimed is:

1. In an automotive vehicle powered by an internal combustion engine having a combustion air passage which is selectively throttled by a throttle mechanism that is selectively positioned between full open and idle positions by an electric motor in accordance with certain signals to an electric control circuit for the electric motor, one of said signals being an accelerator pedal signal indicating whether or not an accelerator pedal for accelerating the engine is being depressed, the improvement which comprises a second one of said signals being a brake pedal signal indicating whether or not a brake pedal for braking the vehicle is being depressed, a third one of said signals being a throttle position signal indicating the position of said throttle mechanism, and means for allowing operation of the engine to continue as long as the throttle position signal indicates at least a certain selected degree of throttling by said throttle mechanism when the accelerator pedal signal and the brake pedal signal concurrently respectively indicate that the accelerator pedal is not being depressed and that the brake pedal is being depressed and for disallowing operation of the engine to continue if the throttle position signal fails to indicate at least said certain selected degree of throttling when the accelerator pedal signal and the brake pedal signal concurrently respectively indicate that the accelerator pedal is not being depressed and that the brake pedal is being depressed.

2. In an automotive vehicle powered by an internal combustion engine having a combustion air passage which is selectively throttled by a throttle mechanism that is selectively positioned between full open and idle positions by an electric motor in accordance with certain signals to an electric control circuit for the electric motor, one of said signals being an accelerator pedal signal representing the position of an accelerator pedal for controlling the speed of the engine, the improvement which comprises a second one of said signals being a brake pedal signal representing the position of a brake pedal for braking the vehicle, a third one of said signals being a throttle position signal representing the position of said throttle mechanism, and means for allowing operation of the engine to continue as long as the throttle position signal represents at least a certain selected degree of throttling by said throttle mechanism when the accelerator pedal signal and the brake pedal signal concurrently respectively represent that the accelerator pedal is commanding less than a certain speed for the vehicle and that the brake pedal is in other than a fully released condition and for disallowing operation of the engine to continue if the throttle position signal fails to represent at least said certain selected degree of throttling when the accelerator pedal signal and the brake pedal signal concurrently respectively represent that the accelerator pedal is commanding less than said certain speed for the engine and that the brake pedal is in other than fully released position.

3. In an automotive vehicle powered by an internal combustion engine having a combustion air passage which is selectively throttled by a throttle mechanism that is selectively positioned between full open and idle positions by an electric motor that is operated by an electric control circuit, said circuit comprising plural sensors, one of said sensors being an accelerator position sensor that senses the position of an accelerator for controlling the speed of the engine, the improvement which comprises a second one of said sensors being a brake position sensor that senses the position of a brake for braking the vehicle, a third one of said sensors being a throttle position sensor that senses the position of said throttle mechanism, and means for allowing operation of the engine to continue as long as the throttle position sensor senses at least a certain selected degree of throttling by said throttle mechanism when the accelerator sensor and the brake sensor concurrently respectively sense that the accelerator is commanding less than a certain speed for the vehicle and that the brake is in other than a fully released condition and for disallowing operation of the engine to continue if the throttle position sensor fails to sense at least said certain selected degree of throttling when the accelerator sensor and the brake sensor concurrently respectively sense that the accelerator is commanding less than said certain speed for the engine and that the brake is in other than fully released position.

4. In an automotive vehicle powered by an internal combustion engine having a combustion air passage which is selectively throttled by a throttle mechanism that is selectively positioned between full open and idle positions by an electric motor that is operated by an electric control circuit, said circuit comprising plural sensors, one of said sensors being an accelerator sensor that senses whether or not an accelerator for controlling the speed of the engine is being actuated, the improvement which comprises a second one of said sensors being a brake sensor that senses whether or not brakes for braking the vehicle are being applied, a third one of said sensors being a throttle position sensor that senses the position of said throttle mechanism, and means for allowing operation of the engine to continue as long as the throttle position sensor senses at least a certain selected degree of throttling by said throttle mechanism when the accelerator sensor and the brake sensor concurrently respectively sense that the accelerator is commanding less than a certain speed for the vehicle and that the brakes are being applied and for disallowing operation of the engine to continue if the throttle position sensor fails to sense at least said selected degree of throttling when the accelerator sensor and the brake sensor concurrently respectively sense that the accelerator is commanding less than said certain speed for the engine and that the brakes are not being applied.

5. In an automotive vehicle powered by an internal combustion engine having a combustion air passage which is selectively throttled by a throttle mechanism that is selectively positioned between full open and idle positions by an electric motor that is operated by an electric control circuit, said circuit comprising plural sensors, one of said sensors being an accelerator position sensor that senses the position of an accelerator for controlling the speed of the engine, the improvement in said circuit which comprises a second one of said sensors being a brake position sensor that senses the position of a brake for braking the vehicle, a third one of said sensors being a throttle position sensor that senses the position of said throttle mechanism, output means to selectively allow and disallow the continuance of engine operation, and logic function performing means for acting upon the conditions sensed by said three sensors to cause said output means to either allow or disallow the continuance of engine operation, said logic function performing means comprising means to cause said output means to allow continuance of engine operation unless the accelerator position sensor, the brake position sensor, and the throttle position sensor concurrently respectively sense that the accelerator is commanding less than a certain speed for the engine, that the brake is not being operated, and that the throttle mechanism is not causing at least a selected degree of throttling, in which case said logic function performing means causes said output means to disallow continuance of engine operation.

6. The improvement set forth in claim 5 in which said output means comprises means to selectively allow and disallow continuance of engine operation by selectively allowing and disallowing the continuance of fuel flow into the engine.

7. The improvement set forth in claim 5 in which said accelerator position sensor comprises an accelerator switch and said brake position sensor comprises a brake switch.

8. The improvement set forth in claim 5 further including means providing a time window immediately after the concurrence of the accelerator position sensor sensing that the accelerator is commanding less than said certain speed for the engine and of the brake position sensor sensing that the brake is not being operated during which the throttle position sensor is allowed to sense that the throttle mechanism has not attained said selected degree of throttling without causing said output means to disallow continuance of engine operation.

9. The improvement set forth in claim 5 in which the circuit is constructed and arranged such that the acceleration position sensor and the brake position sensor are required to sense a predetermined minimum time interval for the concurrence of the accelerator commanding a certain speed for the engine and the brake not being operated before it is possible for said output means to disallow continuance of throttle operation.

* * * * *